US011155763B2

(12) United States Patent
Dixon et al.

(10) Patent No.: US 11,155,763 B2
(45) Date of Patent: Oct. 26, 2021

(54) OIL MISCIBLE POLYALKYLENE GLYCOLS AND USES THEREOF

(71) Applicant: Shrieve Chemical Products, Inc., The Woodlands, TX (US)

(72) Inventors: Elizabeth Dixon, Fareham (GB); Christopher Seeton, Conroe, TX (US)

(73) Assignee: SHRIEVE CHEMICAL PRODUCTS, INC., The Woodlands, TX (US)

( * ) Notice: Subject to any disclaimer, the term of this patent is extended or adjusted under 35 U.S.C. 154(b) by 202 days.

(21) Appl. No.: 15/773,570

(22) PCT Filed: Nov. 2, 2016

(86) PCT No.: PCT/US2016/059979
§ 371 (c)(1),
(2) Date: May 4, 2018

(87) PCT Pub. No.: WO2017/079190
PCT Pub. Date: May 11, 2017

(65) Prior Publication Data

US 2018/0320100 A1 Nov. 8, 2018

Related U.S. Application Data

(60) Provisional application No. 62/251,795, filed on Nov. 6, 2015.

(51) Int. Cl.
*C10M 107/34* (2006.01)
*C10M 171/00* (2006.01)
(Continued)

(52) U.S. Cl.
CPC ..... *C10M 107/34* (2013.01); *C10M 171/008* (2013.01); *C10M 2203/1025* (2013.01);
(Continued)

(58) Field of Classification Search
CPC ... A61K 31/355; A61K 38/00; C10M 107/34; C10M 171/008; C10M 2209/1055;
(Continued)

(56) References Cited

U.S. PATENT DOCUMENTS 2,680,749 A 6/1954 Cawley et al.
4,481,123 A 11/1984 Hentschel et al.
(Continued)

FOREIGN PATENT DOCUMENTS

CN 1826400 A * 8/2006
CN 1826400 A 8/2006
(Continued)

OTHER PUBLICATIONS

Pubchem CID: 9827981 Pub: Oct. 25, 2006 (Year: 2006).*
(Continued)

*Primary Examiner* — Latosha Hines
(74) *Attorney, Agent, or Firm* — Kilyk & Bowersox, P.L.L.C.

(57) ABSTRACT

A polyalkylene glycol having an end-group of the general formula:

(I)

in which each $R^2$ independently represents a hydroxyl, alkyl, alkenyl, aryl, heteroaryl, benzyl, or polyalkylene glycol group, and each $R^3$ independently represents a hydroxyl, alkyl, alkenyl, aryl, heteroaryl, benzyl, or polyalkylene glycol group; m is 0, 1, 2, 3, 4, 5 or 6; and
(Continued)

n is 0, 1, 2 or 3. A lubricating oil composition comprising this polyalkylene glycol. A refrigerant composition comprising this polyalkylene glycol. A method of lubricating moving parts of an industrial or automotive system comprising applying a composition to the parts, wherein the composition comprises this polyalkylene glycol.

18 Claims, 3 Drawing Sheets

(51) Int. Cl.

| | |
|---|---|
| ***C10N 20/02*** | (2006.01) |
| ***C10N 20/04*** | (2006.01) |
| ***C10N 20/00*** | (2006.01) |
| ***C10N 30/06*** | (2006.01) |
| ***C10N 30/00*** | (2006.01) |

(52) U.S. Cl.
CPC ..... *C10M 2203/1065* (2013.01); *C10M 2209/104* (2013.01); *C10M 2209/1045* (2013.01); *C10M 2209/1055* (2013.01); *C10N 2020/011* (2020.05); *C10N 2020/02* (2013.01); *C10N 2020/04* (2013.01); *C10N 2020/101* (2020.05); *C10N 2030/06* (2013.01); *C10N 2030/70* (2020.05)

(58) Field of Classification Search
CPC .. C10M 2209/1085; C10M 2209/1045; C10M 2209/1065; C10M 2209/104; C10M 2203/1025; C10M 2203/1065; C10N 2020/011; C10N 2020/02; C10N 2020/04; C10N 2020/101; C10N 2030/06; C10N 2030/70; C10N 2220/021; C10N 2220/022; C10N 2220/023; C10N 2220/302; C10N 2230/06; C10N 2230/70
See application file for complete search history.

(56) References Cited

U.S. PATENT DOCUMENTS

| | | | | |
|---|---|---|---|---|
| 4,793,939 | A | 12/1988 | Mori et al. | |
| 4,857,218 | A | 8/1989 | Meschke et al. | |
| 4,973,414 | A | 11/1990 | Merger et al. | |
| 5,143,640 | A | 9/1992 | Moxey | |
| 5,494,595 | A | 2/1996 | Nieh | |
| 5,569,408 | A | 10/1996 | Peppmoller et al. | |
| 5,576,275 | A | 11/1996 | Moxey | |
| 5,652,204 | A | 7/1997 | Cracknell et al. | |
| 6,903,055 | B2 | 6/2005 | Lawford et al. | |
| 7,060,199 | B2 | 6/2006 | Woydt et al. | |
| 2001/0011716 | A1 | 8/2001 | Kaneko et al. | |
| 2003/0149099 | A1* | 8/2003 | Zhang | C07D 311/72 514/458 |
| 2003/0153470 | A1* | 8/2003 | Lawford | C10M 169/04 508/199 |
| 2007/0254859 | A1* | 11/2007 | Wempe | C07J 17/00 514/172 |
| 2015/0027146 | A1 | 1/2015 | Boussand | |

FOREIGN PATENT DOCUMENTS

| | | | | |
|---|---|---|---|---|
| EP | 0400894 | A1 | 12/1990 | |
| WO | WO-0157164 | A1 * | 8/2001 | C08G 65/2636 |
| WO | 2010075046 | A2 | 7/2010 | |

OTHER PUBLICATIONS

National Center for Biotechnology Information. PubChem Compound Database; CID=9827981, https://pubchem.ncbi.nlm.nih.gov/compound/9827981 (9 pages).
International Search Report and Written Opinion issued in corresponding International Patent Application No. PCT/US2016/059979 dated Jan. 24, 2017 (7 pages).
Extended European Search Report issued in corresponding European Patent Application No. 16862816.2 dated Jun. 3, 2019 (6 pages).

* cited by examiner

OIL MISCIBLE POLYALKYLENE GLYCOLS AND USES THEREOF

This application is a National Stage Application of PCT/US2016/059979, filed Nov. 2, 2016, which claims priority to U.S. Provisional Patent Application No. 62/251,795, filed Nov. 6, 2015.

FIELD OF THE INVENTION

This invention relates to a new polyalkylene glycol (PAG) oil for use in industrial and automotive lubricating applications. Specifically, the oil may be used in applications where mineral oil compatibility is of benefit

BACKGROUND TO THE INVENTION

The use of PAGs in lubricating compositions has been known for a considerable time, however their hydrophilic nature results in a tendency towards insolubility/immiscibility in mixtures with mineral oils.

Table 1 below provides a qualitative assessment of the relative benefits and disadvantages of the common lubricant base oil types.

TABLE 1

| Property | Mineral | Di-ester | Polyol Ester | Dimer Ester | Aromatic Ester | Mono-Ester | PAO | PAG | Silicone |
|---|---|---|---|---|---|---|---|---|---|
| Viscosity Index | F | VG | VG | VG | P | VG | G | E | E |
| Low Temp Fluidity | P | E | VG | G | F | E | E | E | E |
| High Temp Stability (inhibited) | P | G | VG | F | G | P | G | G | E |
| Low Volatility | P | E | E | E | E | F | E | G | VG |
| Frictional Properties | F | E | VG | E | G | G | G | E | P |
| Biodegradability | P | E | VG | G | P | E | F | F | P |
| Hydrolytic Stability | E | F | G | F | F | P | E | E | VG |
| Additive Solubility | E | VG | VG | VG | VG | VG | G | F | P |
| Elastomer Compatibility | VG | P | F | VG | P | P | G | VG | VG |
| Paint Compatibility | G | P | G | E | P | P | E | P | VG |
| Petroleum (mineral oil) Compatibility | E | G | G | VG | G | G | E | P | P |
| Initial Cost | E | G | G | VG | G | G | VG | G | P |

(E = Excellent, VG = Very Good, G = Good, F = Fair, P = Poor).

In the field of refrigeration, the global warming impact of HCFC gases such as R22 (chlorodifluoromethane, $CHClF_2$), has led to increased use of HFC gases such as HFC R134a (1,1,1,2-tetrafluoroethane, $CH_2FCF_3$), HFC R407C, a non-ozone depleting zeotropic blend of difluoromethane (R-32), pentafluoroethane (R-125) and 1,1,1,2-tetrafluoroethane (R-134a), and R-410A, a non-ozone depleting zeotropic blend of difluoromethane (R-32) and pentafluoroethane (R-125). R407C is designed to match as closely as possible the R22 pressure and performance characteristics to enable smooth transition to R407C. R410A was designed to provide benefits in efficiency and system size by increasing system pressure and taking advantage of thermodynamic properties. Under the terms of the Montreal Protocol, as of Jan. 1, 2020 US manufacturers will no longer be able to utilize R22 to service existing equipment. Equipment transition from R22 to R407C/R410A similarly requires a compressor lubricant transition from R-22 miscible lubricant types, commonly mineral oil based products, to HFC miscible lubricants which are commonly polar synthetic lubricant types such as polyol esters (POEs) and PAGs.

In many respects PAGs provide a superior choice with respect to performance characteristics, however they are disadvantaged by a lack of compatibility with petroleum derived mineral oils. Currently, no economically-viable PAG having a broad spectrum of mineral oil compatibility over a range of petroleum base-oil types and across the broad temperature range required for many industrial lubricating applications, is available. The problem to be solved therefore is to find a PAG offering broad petroleum-derived base-oil compatibility, suitably with respect to both paraffinic and naphthenic types, across a broad temperature operating range, whilst retaining the property benefits typically associated with PAGs.

A number of attempts have been made to provide such PAGs. Generally, these have required the use of alkylene oxide units having high molecular weight. Thus, U.S. Pat. No. 4,481,123 discloses a PAG lubricant suitable for power-transmission gears, wherein such lubricants are obtained by polymerization of an α-alkylene oxide, said α-alkylene oxide having an alkylene radical which contains 8 to 26 carbon atoms, and a tetrahydrofuran. EP-A-0-246612 discloses a PAG of the type: $R[(C_nH_{2n}O)_x—(C_mH_{2m}O)_yH]_z$, wherein R is the residue of a compound having 1-8 active hydrogen atoms, n=integer of 2-4, m=integer of 6-40, x and y are an integer, and z=1-8.

These PAGs have a molecular weight of 500-100,000 and a $C_6$-$C_{40}$ alkylene oxide content of 15-60% of the entire molecule weight.

U.S. Pat. No. 4,973,414 discloses monofunctional polyethers characterised in that they contain as built-in terminal groups or monomers, a) from 1 to 30% by weight of one or more $C_{4-}$ to $C_{24-}$ alkylmonophenols, b) from 1 to 30% by weight of one or more $C_{8-}$ to $C_{24-}$ monoalkanols, c) from 1 to 30% by weight of one or more $C_{10-}$ to $C_{20-}$ 1,2-epoxyalkanes, and d) from 45 to 80% by weight of propylene oxide or a lower alkylene oxide mixture predominantly comprising propylene oxide, with the sum of components a) to d) adding up to 100% by weight; and in that they have mean molecular weights of from 600 to 2500.

U.S. Pat. No. 5,143,640 discloses a polyalkylene glycol of the formula: $R^1X—[(C_3H_6O)_n(C_yH_{2y}O)_p—H]_m$, wherein R is an alkyl or alkylphenyl group having 9 to 30 carbons atoms; X=O, S or N; x is 2 to 4; y is 6 to 30; m is 1 or 2; and n and p are such that the polyether contains between 1 and 35 wt % of $(C_yH_{2y}O)$ units and between 35 and 80 wt % of $[(C_3H_6O)$ units.

EP 0 532 213 discloses a sequential block copolymer which has the formula:

$$R^1X—[(C_yH_{2y}O)_m—(C_xH_{2x}O)_n—H]_q$$

wherein $R^1$=alkyl or alkaryl having 1 to 30 carbons atoms, X is O, S or N, x is an integer of 2 to 4, y is an integer of 6 to 30, q=1 when X is O or S and q=2 when X is N; and m and n are such that the molecular weight is in the range 600-4000. U.S. Pat. No. 5,652,204 discloses similar polyethers capped with a hydrocarbyl end group containing from 1 to 30 carbon atoms. All of the above documents attempt to achieve mineral oil soluble PAGs by using $C_4$ and higher alkylene oxide monomers. Generally, such PAGs have limited commercial viability due to cost. In addition, none of the documents discloses the use of the polyethers described as lubricants for application in refrigeration/air-conditioning applications where temperature extremes are commonly encountered.

WO 01/57164 discloses compositions comprising a lubricating oil and a refrigerant, the lubricating oil comprising a PAG of formula $RX(R^aO)_x(R^bO)_y(R^cO)_zR^d$, wherein R is a $C_3$ to $C_{15}$ substituent comprising a heterocyclic ring in which the heteroatom(s) in said ring is/are oxygen and/or sulfur; $R^a$, $R^b$ and $R^c$ are respectively $C_2$, $C_3$ and $C_4$ alkylene groups; $R^d$ is the same as R, or is H, $C_1$-$C_{20}$ alkyl or $C_1$-$C_{20}$ acyl; x, y and z are 0 to 100, and the sum of x, y and z is 4-100. Preferred heterocycles present in R are $C_{4-6}$ heterocycles. This disclosure is concerned with refrigeration and air-conditioning, and the stated advantage is that there is no separation from refrigerant at low temperature. There is no suggestion of mineral oil compatibility.

We have now found that the inclusion of a specific heterocyclic end group in a PAG leads to a product with desirable lubricant properties which is fully miscible with mineral oil, unlike the products exemplified in WO 01/57164.

SUMMARY OF THE INVENTION

The invention provides a polyalkylene glycol having an end-group of the general formula:

1. a. (I)

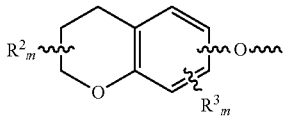

in which each $R^2$ independently represents a hydroxyl, alkyl, alkenyl, aryl, heteroaryl, benzyl, or polyalkylene glycol group, and each $R^3$ independently represents a hydroxyl, alkyl, alkenyl, aryl, heteroaryl, benzyl, or polyalkylene glycol group; m is 0, 1, 2, 3, 4, 5 or 6; and n is 0, 1, 2 or 3.

The invention further provides a lubricating oil composition comprising a polyalkylene glycol according to the invention; a refrigerant composition which comprises a refrigerant together with a polyalkylene glycol or a lubricating oil composition according to the invention; and a refrigeration system which comprises a refrigerant composition according to the invention.

In method aspects, the invention provides a method of lubricating moving parts of an industrial or automotive system, which comprises applying to moving parts a polyalkylene glycol or a lubricating oil composition according to the invention; and a method of servicing an industrial or automotive system, which comprises adding a polyalkylene glycol or a lubricating oil composition, to that system.

DETAILED DESCRIPTION OF THE INVENTION

In the formula I, ~O~ indicates the point at which the PAG chain is bonded to the end group. The PAG according to the invention may contain $C_2$ alkylene oxide (ethylene oxide) monomer units, $C_3$ alkylene oxide (propylene oxide) monomer units, and/or higher alkylene oxide units, for example $(C_{4-8})$alkylene oxide units. It may be a homopolymer or it may contain a mixture of different units, for example in the form of a random copolymer or a block copolymer. It may be linear or branched, but is preferably linear. If it is a linear PAG, it may for example have the general formula:

$$i.\ R[(C_xH_{2x}O)_p(C_yH_{2y}O)_q(C_zH_{2z}O)_r]R^1 \quad \text{(II)}$$

wherein

R is the group of formula I;

$R^1$ is a hydrogen atom, an alkyl group, especially a $C_{1-20}$alkyl group, an acyl group, especially a $C_{1-20}$acyl group, or a group of formula I;

x is 2; y is 3; and z is from 4 to 8;

and each of p, q and r independently is a number from 0 to 350, provided that the total of p, q and r is at least 2, preferably at least 4.

Although it is possible to use higher alkylene units in the PAG of the invention and obtain all the advantages of the invention, it is a major economic advantage of the present invention that its benefits can be obtained by using only $C_2$ and/or $C_3$ alkylene oxide units. Therefore preferably the number of higher ($C_4$ and greater) alkylene oxide units, for example r in formula II, is 0. Preferably the number of $C_2$ units, p in the above formula, is lower than the number of $C_3$ units, for example q in the above formula, and is preferably 0. Preferably the number of $C_3$ units, for example q in the above formula, is from 2 to 350, for example from 2 to 50, especially from 4 to 50. Except where the context requires otherwise, any reference to a PAG according to the invention throughout this Specification should be understood to include a specific reference to a PAG which contains only $C_2$ and/or $C_3$, especially only $C_3$, alkylene oxide units.

Preferably the end group of formula I contains at least one substituent $R^3$ or, preferably, $R^2$, which is an alkyl or alkenyl, especially alkyl, group having from 8 to 20, especially from 12 to 20, carbon atoms.

If more than one $R^2$ group is present, these may be the same or different. Preferably each group $R^2$ present is an alkyl group. An alkyl or alkenyl group $R^2$ may be straight-chain or branched, and preferably has up to 20 carbon atoms. An aryl group $R^2$ is preferably a phenyl group optionally substituted by one or more $C_{1-4}$, especially methyl, groups. A heteroaryl group $R^2$ preferably contains from 5 to 10 ring atoms of which from 1 to 3 are heteroatoms selected from oxygen, sulfur and nitrogen. An acyl group group $R^2$ preferably has the formula $R^{2a}CO$— in which $R^{2a}$ is a benzyl or, especially, alkyl group, especially an alkyl group having up to 20 carbon atoms. A polyalkylene group $R^2$ may be as described above. Preferably at least one $R^2$ which is an alkyl or alkenyl, especially alkyl, group having from 8 to 20, especially from 12 to 20, carbon atoms is present, in which case any other $R^2$ groups present are preferably methyl groups.

If more than one $R^3$ group is present, these may be the same or different. Preferably each group $R^3$ present is an alkyl group. An alkyl or alkenyl group $R^3$ may be straight-chain or branched, and preferably has up to 20 carbon atoms, especially up to 4 carbon atoms, and is preferably a methyl group. An aryl group $R^3$ is preferably a phenyl group optionally substituted by one or more $C_{1-4}$, especially methyl, groups. A heteroaryl group group $R^3$ preferably contains from 5 to 10 ring atoms of which from 1 to 3 are heteroatoms selected from oxygen, sulfur and nitrogen. An acyl group group $R^3$ preferably has the formula $R^{3a}CO$— in which $R^{3a}$ is a benzyl or, especially, alkyl group, for example an alkyl group having up to 20 carbon atoms, especially an alkyl group having up to 4 carbon atoms. A polyalkylene group $R^3$ may be as described above.

Preferably m is 2, and preferably one $R^3$ represents a methyl group and the other $R^3$ represents a $C_{8-20}$, especially $C_{12-20}$, alkyl group. Preferably n is 1, 2 or 3 and, preferably each $R^3$ is a hydroxyl group or, especially, a methyl group.

The number of end groups in the PAG according to the invention will of course depend on whether the PAG is linear or branched. A linear PAG has two end groups, and a branched PAG has three or more end groups depending on the degree of branching. It is possible for both or all of the end groups to be a group of the formula I. Preferably however only one end group is a group of the formula I, and the or each other end group(s), le in Formula II, is a methyl group or, especially, a hydrogen atom.

Preferably the total number of carbon atoms in the end group of the formula I is at least 16, especially at least 20, most preferably at least 25. Throughout this Specification, except where the context requires otherwise, any reference to a PAG according to the invention should be understood to include a specific reference to a PAG in which the total number of carbon atoms in the end group of the formula I is at least 16, especially at least 20, most preferably at least 25.

Tocopherols are readily available natural products, and in one preferred embodiment, the group of formula I is derived from a tocopherol, which may for example be alpha-tocopherol, beta-tocopherol, gamma-tocopherol or delta-tocopherol, or any mixture thereof:

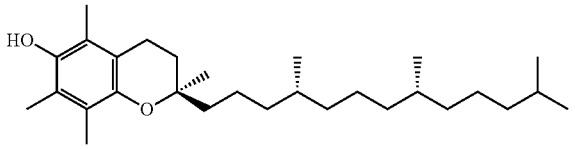

alpha-tocopherol

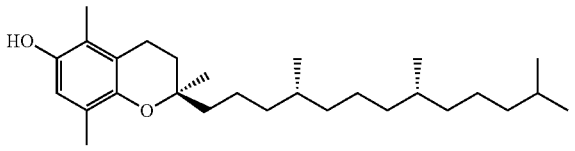

beta-tocopherol

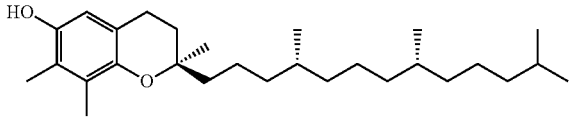

gamma-tocopherol

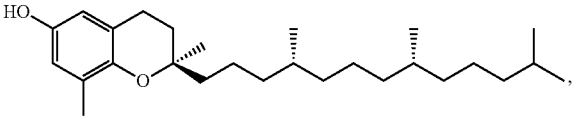

delta-tocopherol bonding to the rest of the PAG molecule being via the oxygen atom of the hydroxyl group.

Preferably the number average molecular weight of the PAG according to the invention is from 518 to 20,000. Suitably it exhibits a kinematic viscosity in the range 10 to 430 cSt at 40° C. (measured according to ASTM D445), a flashpoint (measured using the Cleveland Open Cup, COC, method) of at least 260° C., and/or a pourpoint of at least −10° C.

The PAGs according to the invention may be prepared by methods analogous to methods known in the art. A variety of methods of making end-capped PAGs are known, and any of these may be used. For example, an alcohol, for example a tocopherol, may be used as an initiator for a polymerization reaction, and the PAG chain may be built up from appropriate alkylene oxide units. If a monoalcohol is used, a PAG containing one PAG chain will result. If it is desired to prepare a compound having two or more PAG chains, an alcohol having two or more hydroxyl groups may be used as an initiator.

Utility

The PAG according to the invention finds utility as a lubricant, for example in industrial and automotive applications, where it may be used to lubricate the moving parts of any industrial plant or vehicle by application to the moving parts of the equipment. In a preferred embodiment, it finds utility as a lubricant in refrigerant compositions, particularly as a lubricant for use in the compressors of air conditioning, other refrigeration, or heat pump systems.

The invention therefore provides a lubricant oil composition containing a PAG according to the invention. The PAG according to the invention may be the only oil in such a lubricant composition, or one or more other lubricating oils, for example a petroleum derived mineral oil, an alkylbenzene, a polyalphaolefin, a polyol ester, a polyvinylether, or another PAG, or mixtures thereof, may also be present. Preferably the lubricating oil present in a composition according to the invention contains at least 0.1% wt, especially at least 1.0% wt, for example at least 10% wt or at least 20% wt of the PAG according to the invention. When a mineral oil is present, this is preferably present in an amount of less than 20% wt, the balance of the lubricating oil being PAG, which may consist entirely of a PAG according to the invention or which may in addition contain one or more known PAGs. Preferably however the composition according to the invention contains no lubricating oil other than the PAG according to the invention optionally together with one or more known PAGs, the proportion of the PAG according to the invention in such a composition preferably being one of those mentioned above. Compositions according to the invention which contain a PAG according to the invention together with a known PAG, there being no other lubricating oil present, form one preferred embodiment of the invention.

Although the oil in a lubricating composition according to the invention preferably only contains PAGs, the miscibility of the PAG according to the invention with other oils and particularly with mineral oil provides a major advantage. This is because, when systems using a lubricant, for example refrigerant systems, are serviced, or more particularly retrofitted, fresh lubricant needs to be added and this is frequently a different type of lubricant from that which is originally provided with the system. Lack of miscibility when changing from mineral oil based lubricants to PAG type lubricants, or topping up existing lubricant, can cause major problems within the system. Therefore miscibility with other lubricants, and specifically with mineral oil lubricants which are the most widely used type of lubricant, is a major advantage. The lubricant composition of the invention may be used as the initial lubricant in a system, but in one preferred embodiment, it is used as a top-up or replacement fluid during repair or servicing of a system, for example it may be used in a system where that system has previously utilized a mineral oil-based lubricant and where residual mineral oil is or may be present in the system.

The PAG according to the invention is believed to exhibit full miscibility with paraffinic and naphthenic mineral oils in all weight % ratios over the entire temperature range of +60° C. to −40° C. Further, it imparts miscibility to blends with other PAGs. Specifically, at a minimum concentration of 1.0% wt in a typical oil-immiscible PAG, full mineral oil compatibility can be shown to be imparted to the blend.

Lubricant compositions according to the invention will generally include one or more known additives depending on the particular application. They may for example contain additives selected from those that provide improved anti-wear properties, extreme pressure resistance, oxidation stability, corrosion inhibition, antifoaming, suppression of pourpoint, improvement of viscosity index, and reduction of acid content. Such additives are preferably present in an amount of up to 15% by weight of the composition.

Suitably the lubricating composition of the invention exhibits a kinematic viscosity in the range 10 to 430 cSt at 40° C., a flashpoint of at least 260° C., and/or a pourpoint of at least −10° C.

Refrigerant systems should be understood to include air-conditioning systems, for example in building or, especially, vehicles, other cooling systems such as industrial and domestic refrigeration systems, and heat pump systems. The refrigerant utilized in the refrigerant system may for example comprise a refrigerant selected from hydrofluorocarbons (HFC), hydrochlorofluorocarbons (HCFC), for example R22, carbon dioxide, ammonia, hydrocarbons (HC), for example R600a (i-butane) and R290 (propane), and hydrofluoro-olefins (HFO) such as 1,3,3,3-tetrafluoroprop-1-ene and 2,3,3,3-tetrafluoroprop-1-ene.

Accordingly, the present invention provides a refrigerant composition which comprises a refrigerant, together with, as lubricant, a PAG according to the invention or a lubricant composition according to the invention. Preferably the refrigerant is selected from an HCFC, HFC, HFO, HC, $CO_2$ or $NH_3$.

The present invention provides a lubricant demonstrating the advantage of oil miscibility with preferential refrigerant miscibility characteristics, thus facilitating refrigeration system retrofitting from R22 to R407C/R410A as described above without the need for complete removal of residual mineral oil from the system.

In addition to application as automotive and industrial refrigeration lubricants, the present invention finds utility in other industrial and automotive situations where lubrication is required, for example automotive gearbox and crankcase lubricants, and industrial gearbox lubricants. For example, the application of the lubricating oil compositions described herein as components of semi-synthetic automotive crankcase lubricants in combination with petroleum derived mineral oils can enable a reduction in the use of viscosity index modifiers traditionally required for viscosity retention in mineral oil based lubricants, with a corresponding reduction in the likelihood of valve deposits resulting from the degradation of viscosity index improvers.

BRIEF DESCRIPTION OF THE DRAWINGS

FIG. 1 shows the miscibility of comparative PAGs with refrigerant R407C.

FIG. 2 shows the miscibility of the product 10TP of Invention Example 1 with refrigerant R407C.

FIG. 3 shows the miscibility of the product 20TP of Invention Example 2 with refrigerant R407C.

Figure 1:
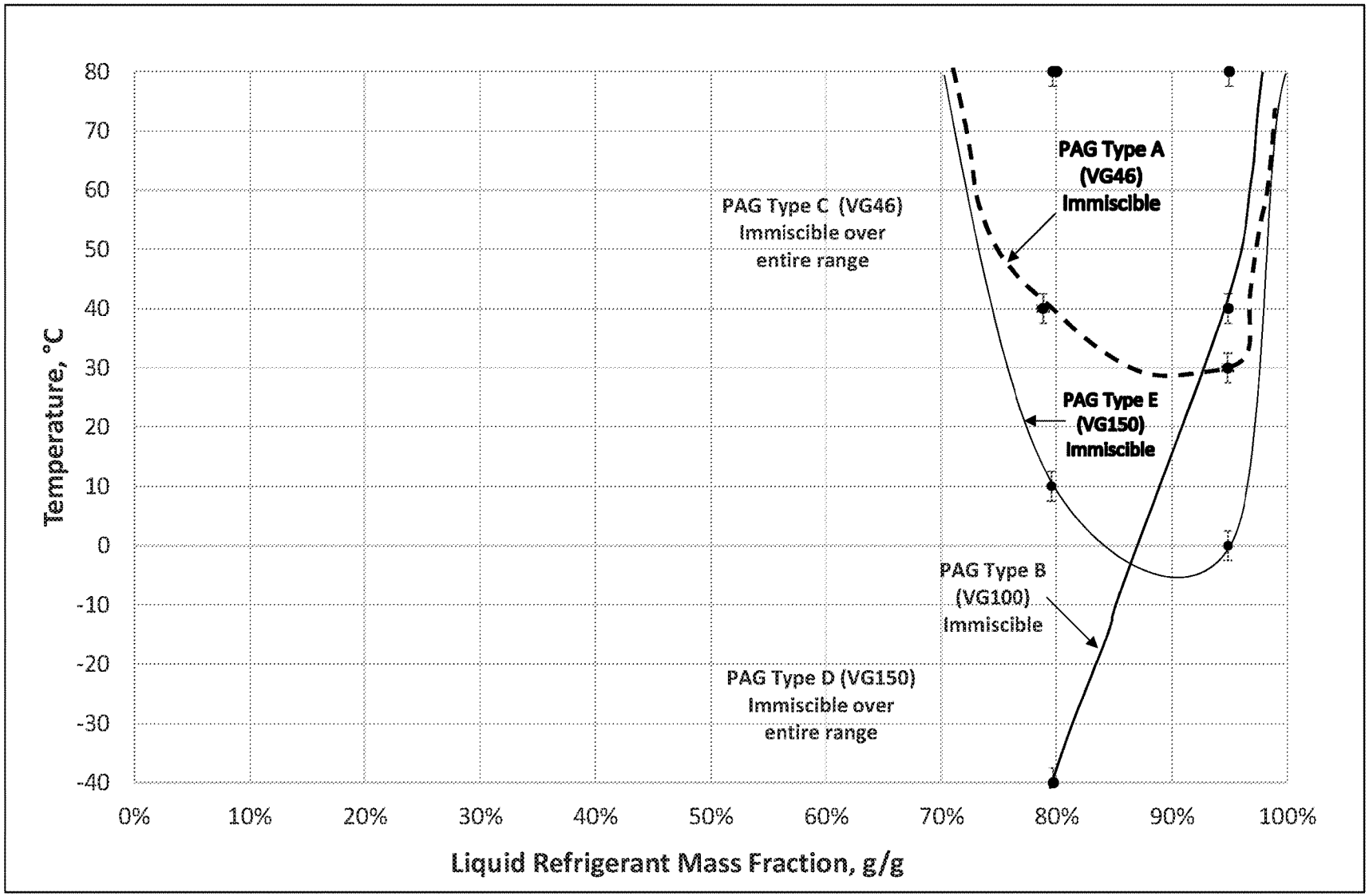
FIGS. 1, 2 and 3 show the results of testing carried out as described in the Examples herein.

The following Examples illustrate the invention.

EXAMPLES

Comparison Products

The miscibility of PAGs according to the invention was compared with miscibility of commercially available PAGs developed and marketed specifically as "oil soluble" polyalkylene glycols for a variety of industrial applications, and also PAGs developed and marketed specifically for refrigeration systems, which are generally not regarded as being "oil soluble". Sample PAG composition was determined using 1H and 13C NMR as solutions in $CDCl_3$. Spectra were acquired at ambient temperature on a Bruker DPX400 NMR spectrometer operating at 400.13 MHz for 1H (MT/CMS/20).

The following comparative examples were utilized in the testing:

TABLE 2

| | Oil Soluble Comparison PAG Type A | | | | Oil Soluble Comparison PAG Type B | |
|---|---|---|---|---|---|---|
| ISO Viscosity Grade (cSt at 40° C.) | 32 | 46 | 68 | 220 | 22 | 100 |
| Pag Initiator type (R) | Linear C12 alcohol | Linear C12 alcohol | Linear C12 alcohol | Linear C12 alcohol | Linear & branched C16-C17 alcohol | Linear & branched C12-C15 alcohol |
| Ethylene Oxide (wt %) (C2H4O) | 0 | 0 | 0 | 0 | 0 | 0 |
| Propylene Oxide (wt %) (C3H6O) | 48.8 | 43.1 | 49.9 | 49.8 | 100 | 100 |
| Butylene Oxide (wt %) (C4H8O) | 51.2 | 56.9 | 50.1 | 50.2 | 0 | 0 |
| Terminating Species (R1) | —OH | —OH | —OH | —OH | —OH | —OH |
| Oxide arrangement | random | random | random | random | — | — |
| Number average molecular weight, Mn | 780 | 1010 | 1260 | 2790 | 477 | 1775 |

TABLE 2-continued

| | Refrigeration Comparison PAG Type C (dicapped PAG) | | Refrigeration Comparison PAG Type D (uncapped PAG) | | Refrigeration Comparison PAG Type E (uncapped PAG) | |
|---|---|---|---|---|---|---|
| ISO Viscosity Grade (cSt at 40° C.) | 46 | 150 | 46 | 150 | 46 | 150 |
| Pag Initiator type (R) | Tetrahydro-furfuryl alcohol | Tetrahydro-furfuryl alcohol | Butanol | Butanol | Butanol | Butanol |
| Ethylene Oxide (wt %) (C2H4O) | 0 | 0 | 0 | 0 | 50 | 50 |
| Propylene Oxide (wt %) (C3H6O) | 100 | 100 | 100 | 100 | 50 | 50 |
| Butylene Oxide (wt %) (C4H8O) | 0 | 0 | 0 | 0 | 0 | 0 |
| Terminating Species (R1) | —CH3 | —CH3 | —OH | —OH | —OH | —OH |
| Oxide arrangement | — | — | — | — | random | random |
| Number average molecular weight, Mn | 1050 | 1880 | 1005 | 1800 | 1000 | 2000 |

where Type A=Dow marketed Oil Soluble PAGs, Type B=Sasol marketed Oil Soluble PAGs, Type C=Shrieve marketed dicapped RFL Refrigeration PAG, Type D=Shrieve marketed single end-capped water insoluble Zerol PAG, Type E=Shrieve marketed single end-capped water soluble Zerol PAG.

Physical property data determined for comparative samples as follows:

TABLE 3

| Property | Test Method | Comparison PAG Type A | | Comparison PAG Type B | | Comparison PAG Type C | | Comparison PAG Type D | | Comparison PAG Type E | |
|---|---|---|---|---|---|---|---|---|---|---|---|
| PAG ISO Viscosity Grade | | 46 | 220 | 22 | 100 | 46 | 150 | 46 | 150 | 46 | 150 |
| Viscosity at 40° C., cSt | ASTM D445 | 49.4 | 211.2 | 20 | 79.4 | 47.7 | 157.4 | 44.2 | 131.3 | 51 | 139.6 |
| Viscosity at 100° C., cSt | ASTM D445 | 8.7 | 31.7 | 4.17 | 14.2 | 9.9 | 28.7 | 8.8 | 28 | 10.8 | 27 |
| Viscosity Index | ASTM D2270 | 159.8 | 194.5 | 110.9 | 186.3 | 201.9 | 222.9 | 183.5 | 251.8 | 209.4 | 231.4 |
| Pourpoint, ° C. | ASTM D97 | <−45 | −40 | −40 | −45 | <−45 | −40 | <−45 | −40 | <−40 | −40 |
| Flashpoint (COC), ° C. | ASTM D92 | 238 | 245 | 211 | 232 | 257 | 248 | 220 | 234 | 250 | 268 |
| 4-ball wear scar (mm) | ASTM D 4172 | 0.59 | 0.42 | 0.61 | 0.46 | 0.57 | 0.61 | 0.46 | 0.48 | 0.55 | 0.52 |
| Falex failure load (lb) | ASTM D3233 | 500 | 750 | 500 | 750 | 1000 | 1000 | 1000 | 1000 | 750 | 1250 |

Measurement of Miscibility

Measurement of miscibility was performed in accordance with the principles of Ashrae 86, in which the blend of mineral oil and test lubricant is prepared and sealed in a sealed glass tube. The temperature of the tube is lowered in 10° C. increments from ambient temperature, to a minimum of −40° C., before warming in 10° C. increments to +60° C. before returning to ambient. For each incremental temperature the sealed glass tube is maintained at that temperature for a period of one hour to observe miscibility, if significant changes in miscibility are observed the temperature increment is reduced to 5° C.

Typical properties of the mineral oils utilized in the miscibility testing are as follows:

TABLE 4

| Property | Test Method | SN150 Paraffinic | L150 Naphthenic |
|---|---|---|---|
| ISO Viscosity Grade | | 32 | 32 |
| Viscosity at 40° C., cSt at 40° C. | ASTM D445 | 30.0 | 30.1 |
| Viscosity at 100° C., cSt at 40° C. | ASTM D445 | 5.1 | 4.5 |

TABLE 4-continued

| Property | Test Method | SN150 Paraffinic | L150 Naphthenic |
|---|---|---|---|
| Viscosity Index | ASTM D2270 | 56.5 | 22.9 |
| Flashpoint (COC), ° C. | ASTM D92 | 208 | 182 |
| API Gravity at 35° C. | ASTM D1250 | 31.8 | 24.2 |
| Total Acid Number, mgKOH/g | ASTM D974 | 0.02 | 0.01 |
| Molecular Weight, g/mol | ASTM D2502 | 393 | 123 |
| Pourpoint, ° C. | ASTM D5950 | −15 | −43 |

Miscibility data was obtained for the combinations of mineral oil and comparative polyalkylene glycol grades as shown:

TABLE 5

Paraffinic Mineral Oil Miscibility with Comparative PAGs

| Lubricant composition (wt % | | | | | | | | | | | | |
|---|---|---|---|---|---|---|---|---|---|---|---|---|
| Par-affinic | Comparable PAG Product Grades | | | | | | | | | | | |
| SN150 MO | Type A VG220 | Type A VG46 | Type A VG68 | Type C VG46 | Type B VG32 | Type B VG100 | Type E VG50 | Type E VG150 | Type D VG50 | Type D VG50 | Observations | Conclusion |
| 20 | 80 | | | | | | | | | | Miscible −40 to 60° C. | Pass |
| 50 | 50 | | | | | | | | | | Miscible 20 to 60° C., cloudy −40 to −20° C., Stridations −10 to −10° C. | Fail |
| 80 | 20 | | | | | | | | | | Miscible −40 to 60° C. | Pass |
| 80 | | 20 | | | | | | | | | Miscible −40 to 60° C., Cloudy −40 to −20° C. | Fail |
| 20 | | 80 | | | | | | | | | Miscible −40 to 60° C. | Pass |
| 80 | | | 20 | | | | | | | | Miscible −40 to 60° C., Cloudy −40 to −20° C. | Fail |
| 20 | | | 80 | | | | | | | | Miscible −40 to 60° C. | Pass |
| 80 | | | | 20 | | | | | | | 2 Phase −40 to 10° C., Miscible 20 to 60° C. | Fail |
| 20 | | | | 80 | | | | | | | Miscible −40 to 60° C. | Pass |
| 80 | | | | | | | 20 | | | | 2 phase from −40 to 60 degC. | Fail |
| 80 | | | | | | | | 20 | | | 2 phase from −40 to 60 degC. | Fail |
| 80 | | | | | | | | | 20 | | 2 phase −40 to 10° C., Miscible 20 to 60° C. | Fail |
| 20 | | | | | | | | | 80 | | Miscible −40 to 60° C. | Pass |
| 80 | | | | | | | | | | 20 | 2 phase from −40 to 60 degC. | Fail |
| 20 | | | | | 80 | | | | | | Miscible −40 to 60° C., Cloudy −40 to −20° C. | Fail |
| 50 | | | | | 50 | | | | | | Miscible −40 to 60° C., Cloudy −40 to −20° C. | Fail |
| 80 | | | | | 20 | | | | | | Miscible −40 to 60° C. | Pass |
| 20 | | | | | | 80 | | | | | Miscible −40 to 60° C., Cloudy −40 to −20° C. | Fail |
| 50 | | | | | | 50 | | | | | Miscible 20 to 60° C., Cloudy −40 to −20° C., Stridations −10 to −10° C. | Fail |
| 80 | | | | | | 20 | | | | | Miscible −40 to 60° C. | Pass |

TABLE 6

Naphthenic Mineral Oil Miscibility with Comparative PAGs

| Lubricant composition (wt % | | | | | | | |
|---|---|---|---|---|---|---|---|
| Naphthenic L150 MO | Type A VG220 | Type A VG48 | Type C VG46 | Type B VG32 | Type B VG100 | Observations | Conclusion |
| 20 | 80 | | | | | Miscible −40 to 60° C. | Pass |
| 50 | 50 | | | | | Miscible −40 to 60° C. | Pass |
| 80 | 20 | | | | | Miscible −40 to 60° C. | Pass |
| 80 | | 20 | | | | Miscible −40 to 60° C. | Pass |
| 20 | | 80 | | | | Miscible −40 to 60° C. | Pass |
| 80 | | | 20 | | | Miscible −40 to 60° C. | Pass |
| 20 | | | 80 | | | Miscible −40 to 60° C. | Pass |
| 20 | | | | 80 | | Miscible −40 to 60° C., hazy at −40 to −20° C. | Fail |
| 50 | | | | 50 | | Miscible −40 to 60° C., hazy at −40 to −30° C. | Fail |
| 80 | | | | 20 | | Miscible −40 to 60° C., hazy at −40° C. | Fail |
| 20 | | | | | 80 | Miscible −40 to 60° C. | Pass |
| 50 | | | | | 50 | Miscible −40 to 60° C. | Pass |
| 80 | | | | | 20 | Miscible −40 to 60° C. | Pass |

FIG. 1 shows the miscibility of the various comparative PAGs with refrigerant R407C.

The criteria required for full mineral oil/polyalkylene glycol miscibility was complete homogeneity of the mixture across the temperature range of test −40° C. to +60° C. Phase separation, cloudiness, haze and striations are indicative of incomplete homogeneity. Results demonstrate a lack of comprehensive mineral oil miscibility across the paraffinic/naphthenic mineral oil types, temperature range of test, and ratios of mineral oil:PAG for the comparative types tested.

INVENTION EXAMPLES

Example 1

10 Mole Tocopherol Propoxylate (Sample "10TP)

In a first step, 213 g of Mixed Tocopherol (commercially available as Mixed Tocopherol, ex-J Edwards International Inc) was dried to a moisture level <10 ppm, and catalysed with solid potassium hydroxide to a dosage of 0.125 wt % in the final product. The catalysed material was dried to 0.01 wt % water content and reacted with 287 g of propylene oxide at 135° C. until pressure line-out in the reaction vessel indicated reaction completion. The catalyst was thereafter removed from the product prior to sample testing. The resulting product contained 10 propylene oxide units per molecule.

Example 2

20 Mole Tocopherol Propoxylate (Sample "20TP)

In a first step 200 g of product from Example 1, prior to catalyst removal, was reacted with 115 g of propylene oxide at 135° C. until pressure line-out in the reaction vessel indicated reaction completion. The catalyst was thereafter removed from the product prior to sample testing. The resulting product contained 20 propylene oxide units per molecule.

Example 3

Testing of the Products of Examples 1 and 2

Figure 2:
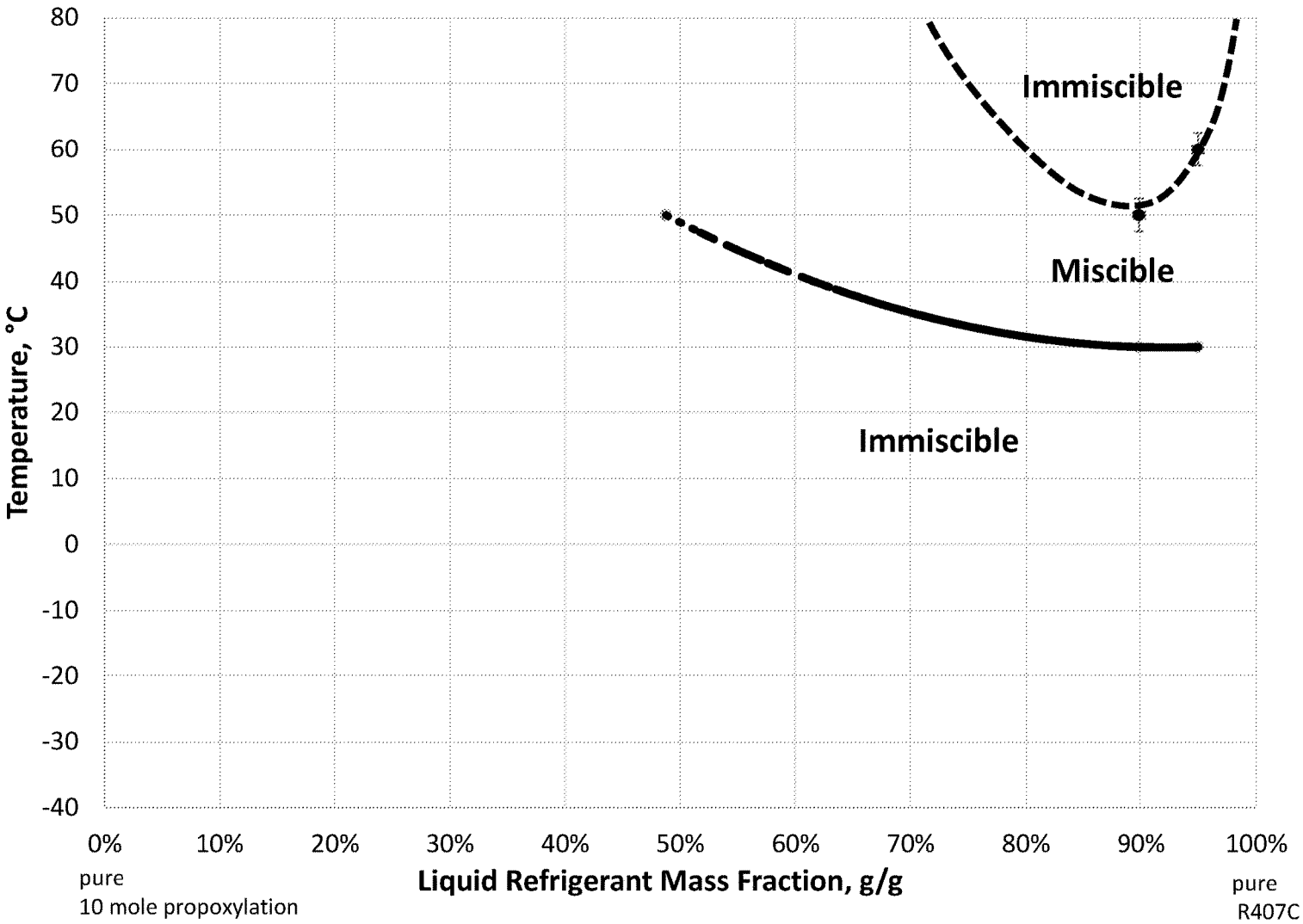
Figure 3:
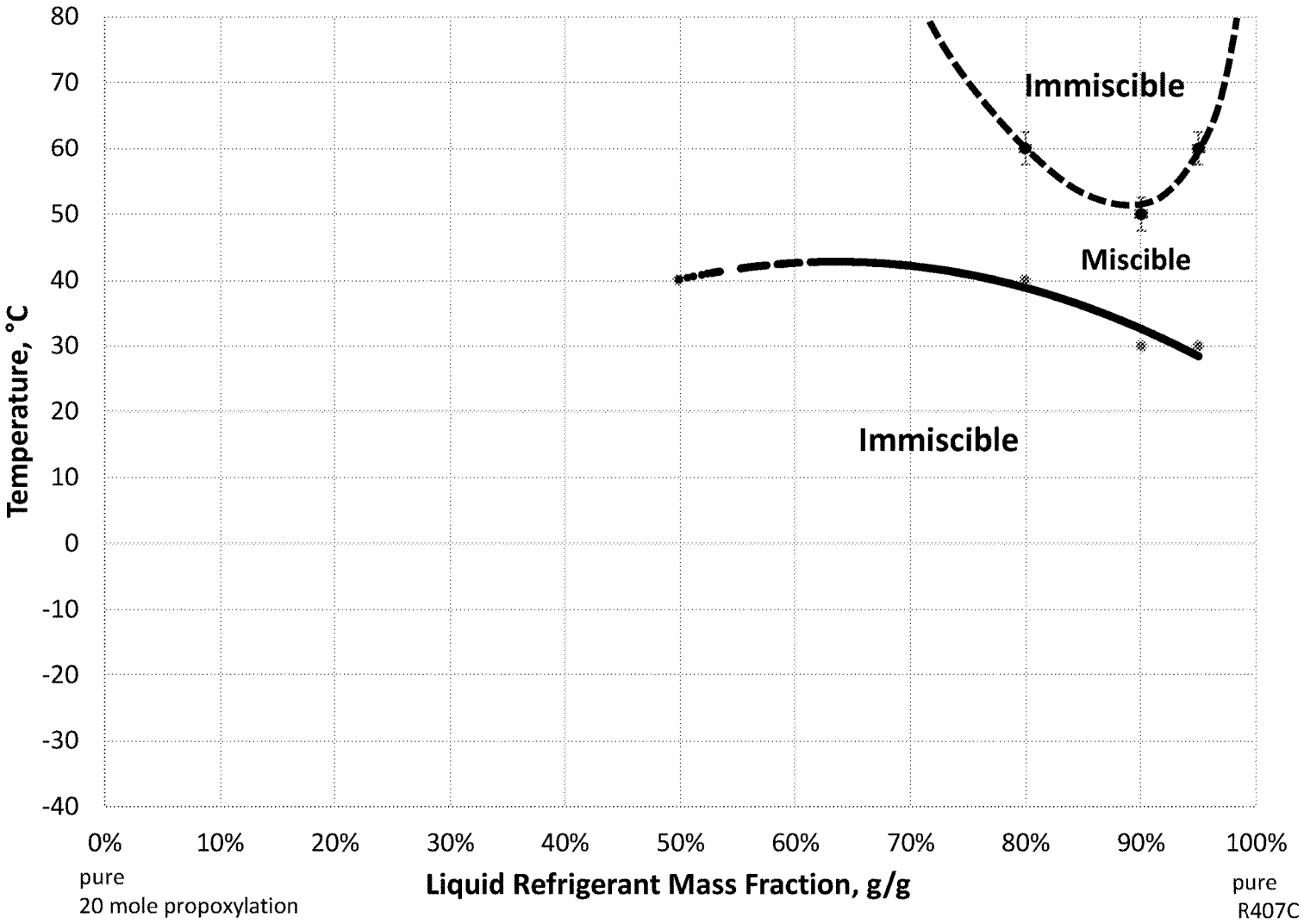

The properties of the products of Examples 1 and 2 were measured using standard industry testing methods. Miscibility was measured as described above. Table 7 shows the basic physical properties. Table 8 shows the mineral oil compatibility of the products. Table 9 shows the minimum quantity of the products of Invention Examples 1 and 2 required to solubilize 90/10 (wt/wt) comparative PAGs D and E and mineral oils. FIGS. 2 and 3 show the miscibility of the products of Invention Examples 1 and 2 with refrigerant R407C.

TABLE 7

Basic physical properties of Invention Examples 1 and 2

| Property | Test Method | Example 1: 10 mole Tocopherol Propoxylate (10TP) | Example 2: 20 mole Tocopherol Propoxylate (20TP) |
|---|---|---|---|
| PAG ISO Viscosity Grade | | 200 | 200 |
| Viscosity at 40° C., cSt | ASTM D445 | 194.5 | 204 |
| Viscosity at 100° C., cSt | ASTM D445 | 17.8 | 22.4 |
| Viscosity Index | ASTM D2270 | 99.4 | 134.1 |
| Pourpoint, ° C. | ASTM D97 | −28 | −32 |
| Flashpoint (COC), ° C. | ASTM D92 | 302 | 293 |
| 4-ball wear scar (mm) | ASTM D 4172 | 0.47 | 0.44 |
| Falex failure load (lb) | ASTM D3233 | 750 | 750 |

TABLE 8

Mineral Oil miscibility for Invention Examples 1 and 2

| Lubricant composition (wt % | | | | |
|---|---|---|---|---|
| | Invention Examples | | | |
| Mineral Oil | Example 1: "10TP" | Example 2: "20TP" | Observations | Conclusion |
| Paraffinic SN150 MO | | | | |
| 20 | 80 | | Miscible −40 to 60° C. | Pass |
| 50 | 50 | | Miscible −40 to 60° C. | Pass |
| 80 | 20 | | Miscible −40 to 60° C. | Pass |
| 20 | | 80 | Miscible −40 to 60° C. | Pass |
| 50 | | 50 | Miscible −40 to 60° C. | Pass |
| 80 | | 20 | Miscible −40 to 60° C. | Pass |
| Naphthenic L150 MO | | | | |
| 20 | 80 | | Miscible −40 to 60° C. | Pass |
| 50 | 50 | | Miscible −40 to 60° C. | Pass |
| 80 | 20 | | Miscible −40 to 60° C. | Pass |
| 20 | | 80 | Miscible −40 to 60° C. | Pass |
| 50 | | 50 | Miscible −40 to 60° C. | Pass |
| 80 | | 20 | Miscible −40 to 60° C. | Pass |

TABLE 9

Minimum % invention required to solubilize 90/10 (wt/wt) Comparative PAGs D and E/Mineral Oils.

| | Lubricant composition (wt % | | | | |
|---|---|---|---|---|---|
| | Comparative Samples | | | | |
| Mineral Oil | Comparative PAG Type E VG150 | Comparative PAG Type D VG150 | Invention Examples invention Example: Tocopherol Propoxylate | Observations | Conclusion |
| Paraffinic SN150 MO | | | | | |
| 10.0 | 90.0 | | | immiscible at room temperature | Fail |
| 7.5 | 67.5 | | 25.0 | Miscible −40 to 60° C. | Pass |
| 10.0 | | 90.0 | | immiscible at room temperature | Fail |
| 9.9 | | 89.1 | 1.0 | Miscible −40 to 60° C. | Pass |
| Naphthenic L150 MO | | | | | |
| 10.0 | 90.0 | | | immiscible at room temperature | Fail |
| 8.5 | 76.5 | | 15.0 | Miscible −40 to 60° C. | Pass |
| 10.0 | | 90.0 | | immiscible at room temperature | Fail |
| 9.9 | | 89.1 | 1.0 | Miscible −40 to 60° C. | Pass |

The above data illustrate the following:

Comparison of Table 3 and Table 7 confirms no disadvantage of products of the invention with respect to inherent properties expected of polyalkylene glycols. Further improvement of the Viscosity Index would be expected simply by increasing the number of propylene oxide units included in the products.

Comparison of Table 4 and Table 7 confirms the advantage of the products of the invention with respect to improvement of Viscosity Index for mineral oil derived products in admixture with products of the invention.

Comparison of Table 5 and Table 6 with Table 8 provides confirmation that the mineral oil miscibility properties of the invention are advantageous, with respect to prior art in this field, with a complete absence of any inhomogeneity demonstrated with either naphthenic or paraffinic mineral oils in all ratios and across the full temperature range of test.

Table 9 demonstrates that utilization of a minimum concentration of the novel polyether of 1.0% wt in a typical oil-immiscible polyalkylene glycol, enables mineral oil compatibility to be imparted to the blend.

Under normal operating conditions the oil circulation rate (OCR) in refrigeration circuits is around 1% in 99% of refrigerant. Towards end of system lifetime where component tolerances become reduced this may increase to around 2-5% oil in refrigerant. Miscibility of lubricant with refrigerant is most desirable in the temperature region of 15/20° C.-60° C. for effective system operation. FIGS. 1, 2 and 3 demonstrate that there is an advantageous impact on the miscibility property with R407C under these lubricant concentration and system temperature conditions for the novel polyethers of the invention, therefore demonstrating superior suitability for use in refrigeration systems R407C systems, which are typically those retrofitted from R22, where residual mineral oil may be present and where the oil solubility properties of the novel polyether are similarly advantageous.

The above results clearly demonstrate that the products of the present invention have advantageous properties making them particularly suitable for use in refrigeration applications where temperature extremes are commonly encountered. Specifically, they are fully miscible with both paraffinic and naphthenic mineral oil. Moreover, they impart miscibility with mineral oils to blends including known PAGs, when those known PAGs are not themselves miscible with mineral oil. Further, they are fully miscible with HFC type refrigerants (typified by R407C), unlike for example the PAGs of WO 01/57164 (comparative PAG Type C). This can all be achieved in economic fashion without incorporating C4+ alkylene oxide units.

The foregoing has outlined the features and technical advantages of the present invention. It will be appreciated by those skilled in the art that the embodiments disclosed may be readily utilized as a basis for modifying or designing other embodiments for carrying out the same purposes of the present invention. Such equivalent constructions do not depart from the spirit and scope of the invention as set forth in the appended claims.

The invention claimed is:

1. A polyalkylene glycol containing at least 4 alkylene glycol units and having an end-group of the general formula:

(I)

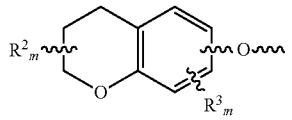

in which m is 2; and one $R^2$ represents a methyl group and the other $R^2$ represents a $C_{12-20}$ alkyl group; each $R^3$ independently represents a hydroxyl, alkyl, alkenyl, aryl, heteroaryl, benzyl, or polyalkylene glycol group; and n is 0, 1, 2 or 3.

2. The polyalkylene glycol as claimed in claim 1, which has the general formula:

$$R[(C_xH_{2x}O)_p(C_yH_{2y}O)_q(C_zH_{2z}O)_r]R^1 \quad \text{(II)}$$

wherein

R is the group of formula I;

$R^1$ is a hydrogen atom, a $C_{1-20}$ alkyl group or a $C_{1-20}$ acyl group, or a group of formula I;

x is 2; y is 3; and z is an integer from 4 to 8;

and each of p, q and r independently is a number from 0 to 350, provided that the total of p, q and r is at least 4.

3. The polyalkylene glycol as claimed in claim 1, in which the number of alkylene oxide monomer units having 4 or more carbon atoms is 0.

4. The polyalkylene glycol as claimed in claim 1, in which the number of alkylene oxide monomer units having 2 carbon atoms is 0.

5. The polyalkylene glycol as claimed in claim 1, in which the number of alkylene oxide monomer units having 3 carbon atoms is from 4 to 50.

6. The polyalkylene glycol as claimed in claim 1, in which one end group of the formula I is present, and the or each other end group is H.

7. The polyalkylene glycol as claimed in claim 1, in which n is 1, 2 or 3 and each $R^3$ is a methyl group.

8. The polyethylene glycol as claimed in claim 1, in which the end group of formula I is derived from a tocopherol.

9. A lubricating oil composition comprising the polyalkylene glycol as claimed in claim 1.

10. The lubricating oil composition as claimed in claim 9, which comprises one or more known additives selected from the group consisting of those that provide improved antiwear properties, extreme pressure resistance, oxidation stability, corrosion inhibition, antifoaming, suppression of pourpoint, improvement of viscosity index, and reduction of acid content.

11. The lubricating oil composition as claimed in claim 9, which also contains another lubricating oil.

12. The lubricating oil composition as claimed in claim 9, which has a kinematic viscosity in the range of from 10 to 430 cSt at 40° C., a flashpoint of at least 260° C., and/or a pourpoint of at least −10° C.

13. A refrigerant composition which comprises a refrigerant together with a polyalkylene glycol as claimed in claim 1.

14. A refrigeration system which comprises a refrigerant composition as claimed in claim 13.

15. The refrigeration system as claimed in claim 14, which includes a compressor in which said refrigerant composition is present.

16. A method of lubricating moving parts of an industrial or automotive system, which comprises applying to said moving parts the polyalkylene glycol as claimed in claim 1.

17. A method of servicing an industrial or automotive system, which comprises adding the polyalkylene glycol as claimed in claim 1.

18. The polyalkylene glycol as claimed in claim 1, wherein said polyalkylene glycol is fully miscible with mineral oil.

* * * * *